United States Patent [19]

Reil

[11] 4,312,450

[45] * Jan. 26, 1982

[54] OPENING MEANS FOR PACKAGING CONTAINERS

[75] Inventor: Wilhelm Reil, Bensheim-Auerbach, Fed. Rep. of Germany

[73] Assignee: Tetra Pak Development S.A., Switzerland

[ * ] Notice: The portion of the term of this patent subsequent to Sep. 23, 1997, has been disclaimed.

[21] Appl. No.: 877,675

[22] Filed: Feb. 14, 1978

[51] Int. Cl.[3] ..... B65D 5/72

[52] U.S. Cl. ..... 206/605; 206/631; 229/7 R

[58] Field of Search ..... 229/7 R, 17 R, 176; 206/607, 631, 605

[56] References Cited

U.S. PATENT DOCUMENTS

| | | | |
|---|---|---|---|
| 2,731,188 | 1/1956 | Alden | 229/176 |
| 3,127,082 | 3/1964 | Meyer-Jagenberg | 229/7 R |
| 3,580,478 | 5/1971 | Bemiss | 206/607 |
| 3,883,034 | 5/1975 | Rousing | 229/7 R |
| 3,977,591 | 8/1976 | Martensson et al. | 229/7 R |

FOREIGN PATENT DOCUMENTS

| | | | |
|---|---|---|---|
| 1061509 | 3/1967 | United Kingdom | 229/7 R |

*Primary Examiner*—Stephen P. Garbe

*Attorney, Agent, or Firm*—Biebel, French & Nauman

[57] ABSTRACT

A dispensing container includes a pouring aperture in its upper wall near a fold line which lies between it and the adjacent side wall. The side wall includes a cut line which forms a flap hinged along the above-mentioned fold line. A layer of plastic material extends across the pouring opening and hinged flap for sealing the container until the contents are to be used. When the plastic material is removed, the pouring aperture is opened and the hinged flap folds out of the plane of the side wall to form a pouring lip which directs the flow of contents away from the side wall.

6 Claims, 2 Drawing Figures

OPENING MEANS FOR PACKAGING CONTAINERS

Figure 1:
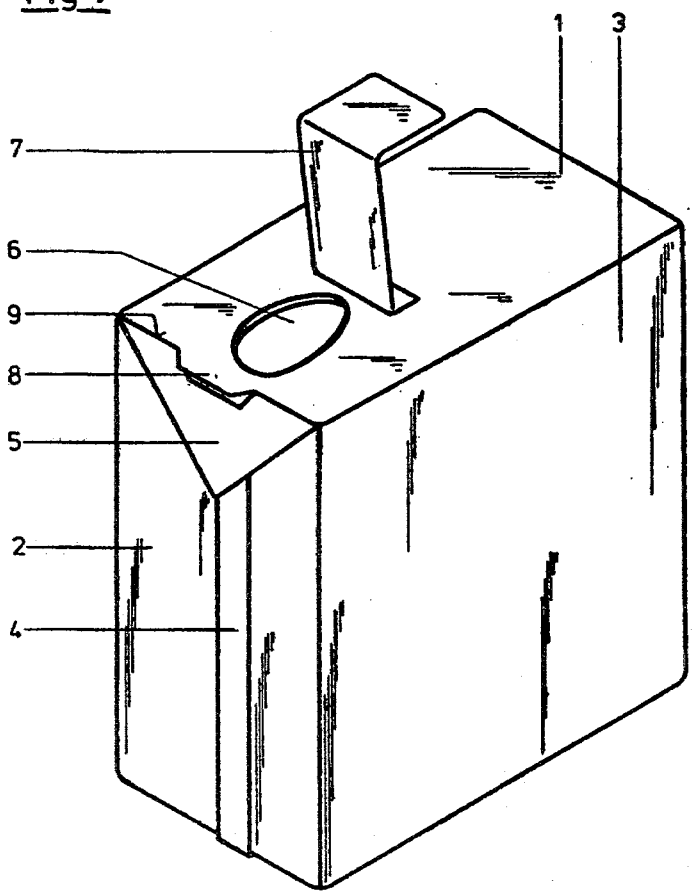

The present invention relates to an opening means for packaging containers which are made of flexible material, and the opening means has at least one pouring opening which is provided in the upper wall of the container and which is disposed adjacent an edge line of the container and is covered with a layer of material which can be broken open.

Liquid foods, i.e. dairy products such as milk, cream, fruit juices and the like are nowadays usually packaged in containers which are intended to be used once. The containers are made from laminated web or sheet material, which usually comprises a main layer of paper or foam and, on both sides thereof, a homogenous layer of thermoplastic material. The containers are formed by folding the sheet or web material, and heating and pressing together the marginal regions of the folded packaging web or sheet material results in liquid-tight and relatively stable containers.

In order to enable the contents of the container to be discharged therefrom, the containers are provided with a form of opening means. In its simplest form, the opening means can comprise a cut-off corner of the container, but usually the opening means used is in the form of complicated opening means which may be opened without the use of tools and which can in addition often be re-closed.

A known packaging container of primarily parallelepiped shape, which is made from a packaging material comprising layers of paper and thermoplastic material, has an opening means of the kind mentioned above, which is disposed on the upper surface of the container. The opening means comprises a pouring opening which is provided in the upper surface of the container and which, to facilitate discharging the contents from the container, is disposed at one of the edge lines which delimit the upper wall from the side surfaces of the container. In order further to facilitate pouring the contents out of the container, the pouring opening is of an elongate or oval configuration and is so oriented that the long axis of the pouring opening extends predominantly normal to the above-mentioned edge line of the container.

This arrangement makes it possible for air to be sucked into the container while the contents thereof are being poured from the container at the same time, the air which is drawn into the container replacing the part of the contents which has already been poured out of the container and ensuring that the contents are poured out of the container in a regular smooth flow. In addition, the opening means has a cover strip of plastics material, which is so disposed at the top of the container that it covers both the pouring opening and also a region surrounding the pouring opening. The cover strip is fluid-tightly sealed to the top of the container in a region around the pouring opening. The cover strip also has an end portion which is not sealed to the container and which is folded and extends upwardly substantially from the top surface of the container, in order to make it easier to break open the cover strip. As already mentioned, the pouring opening is of such a shape that the contents of the container can normally be poured out of the container in a regular and fairly concentrated flow.

If the container is completely full however, and some of the contents is to be poured out through the pouring opening, it has been found that the angle of inclination of the container is so small that the flow of liquid from the container has a tendency to follow the outside of the container, so that the flow of liquid divides and part runs down the side wall of the container. This occurs primarily because the liquid being poured from the container runs over the edge line which is formed when producing the container by folding along a bending line, so that the edge line is slightly rounded and is not sufficiently well defined that the flow of liquid from the container will "come away" from the outside surface of the container. To overcome this problem, it has been proposed that a more marked pouring edge may be provided by means of a separate strip of material which is joined to the top of the container in such a position that it extends substantially over the original edge line of the container. This arrangement provides a well-defined flow of liquid when it is poured from the container, even when the liquid is being poured out of a container which is almost completely full. However, difficulties arise in connection with processing the separate pouring edge member in the automatic packaging machines in which the packaging container is produced and filled, and in addition the pouring edge member can easily suffer damage when the container is being transported.

It is the problem of the present invention, overcoming the advantages of the above-described opening means, to provide an opening means which can be easily and reliably produced and which operates correctly.

In addition, the invention aims to provide an opening means which can be easily produced in the packaging machines which are used at present, without requiring increased technical or economic measures.

According to the invention, this problem is solved in that an opening means for packaging containers which are made from flexible material, which has at least one pouring opening which is disposed in the top wall of the container and is disposed adjacent an edge line of the container and is covered by an openable layer of material, has the characterising features that the container side wall which adjoins the above-mentioned edge line has a slot which extends through the wall and which is disposed below the edge line somewhat at a spacing therefrom and which is sealed by a fluid-tight layer relative to the interior of the container, wherein the portion of material between the edge line and the slot is provided for the purposes of forming a pouring edge member which is disposed in the same plane as the top wall of the container and which projects from the edge line. By virtue of this construction, the above-mentioned portion of material between the edge line and the slot, by virtue of the flexibility of the material thereof, springs outwardly towards a position in which it is in the same plane as the top of the container, when the removable layer of material (i.e. a so-called pull tab) is removed. The above-mentioned portion of material thereafter acts as a pouring edge member.

A preferred embodiment of the opening means according to the invention also has the characterising features that the fluid-tight layer comprises a cover layer in the form of a separate strip which is sealed to the inside surface of the container material, in a region extending around the slot.

A further preferred embodiment of the opening means according to the invention is further characterised in that the cover layer which is provided on the inside of the container material covers both the slot and the region around the slot, and also the pouring opening, while the portion which lies in the pouring opening is sealed to the inside of the tear-off layer of material. By virtue of this arrangement, the cover layer which is provided on the inside of the container material is also broken through, when the tear-off strip or pull-tab is removed from the top of the container.

The slot preferably extends parallel to the edge line, and it has been found that a distance of from 1 to 5 mm between the slot and the edge line results in a pouring edge member of suitable size. In order to facilitate the outward pivotal movement of the pouring edge member to the active position in which it is disposed substantially in the same plane as the top of the container, the slot may have end portions which connect the ends of the slot to the edge line.

In order to facilitate the outward pivotal movement of the pouring edge member when the tear-off strip is removed, the tear-off strip may be joined to the outside of the pouring edge member for example by a connection which can be broken relatively easily. It is also possible for the outward pivotal movement of the pouring edge member to be facilitated by both the pouring edge member and the top wall of the container being connected to a layer of material which after outward pivotal movement endeavours to return to the planar position, for example a portion of suitable resilient plastics material.

The tear-off layer of material advantageously covers both the pouring edge member and the pouring opening, and the pouring edge member is advantageously held in a downwardly bent position when the container is unopened, by securing the layer of material to the outside of the container; holding the pouring edge member in the downwardly bent position ensures that the pouring edge member does not suffer damage when the container is being transported.

Figure 2:
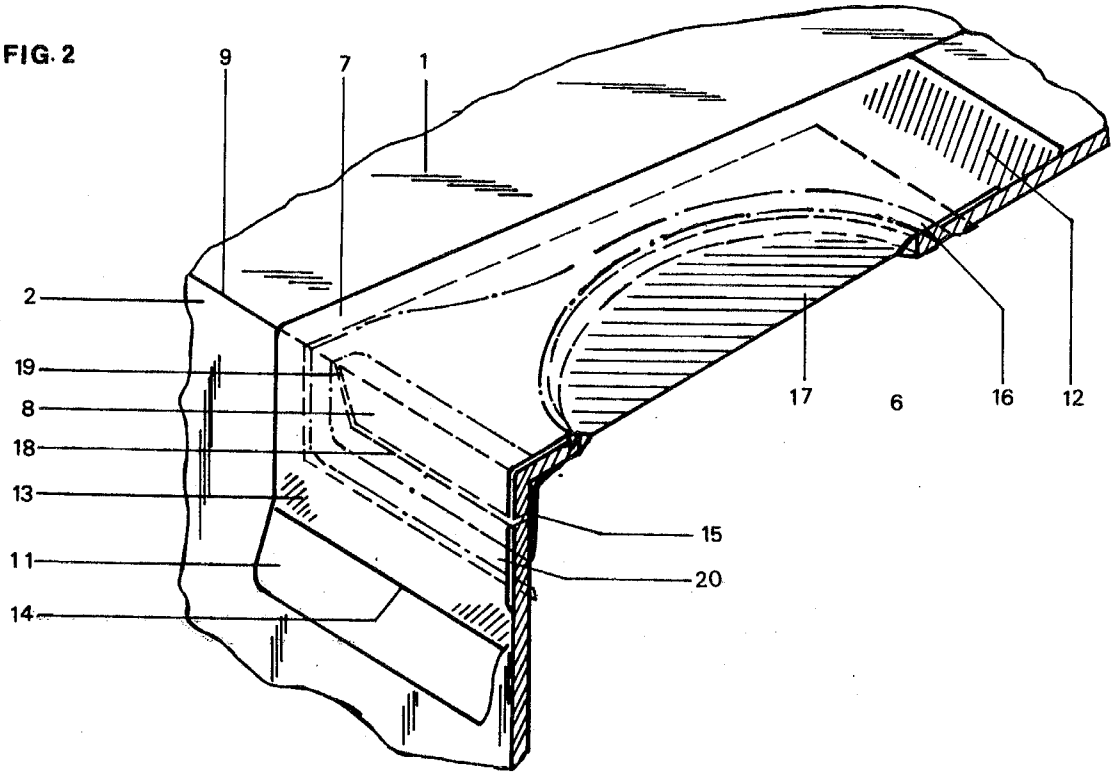

The opening means according to the invention is described in greater detail hereinafter with reference to the accompanying diagrammatic drawings in which:

FIG. 1 shows a packaging container of known kind, with an opening means according to the invention, and FIG. 2 shows a view on an enlarged scale and in partial cross-section of a packaging container with an opening means according to the invention.

The packaging container shown in FIG. 1 is of known parallelepiped shape and is made of laminate material which has a central main layer of paper which is coated on both sides with homogenous thermoplastic material. The material forming the packaging container can also comprise layers of other material, for example a material with good gas barrier properties, such as aluminium foil and the like.

The illustrated container is produced by a process in which a web of the material for forming the container is bent by a packaging machine to form a tube configuration, with a primarily vertically downward movement, whereupon the longitudinal edges are joined together. The tube is filled with the desired contents and then is divided into individual packaging members by successively pressing the tube flat and then sealing it by transverse seals along narrow sealing regions. Finally, the container is subjected to a shaping operation which imparts to the container the desired parallelepiped shape comprising a top face 1, an opposite bottom face (not shown) and four side faces of which only side faces 2 and 3 are shown in FIG. 1. The drawing also shows on the side face 2, one of the sealing seams 4 which is produced when manufacturing the container, and one of the four corner portions 5 which for reasons of geometry are produced when the container is being shaped. The corner portion 5 shown in the drawing is bent downwardly and is connected to the actual side wall 2.

The opening means according to the invention is shown in FIG. 1 in an open condition, from which it will be clearly seen that the opening means comprises a substantially oval discharge means 6, a layer of material which can be torn off, or a cover strip, indicated at 7, and a pouring edge member 8 which can be pivoted outwardly from a position in which it is in the same plane as the side wall 2 (or more precisely the corner portion 5). In the following more detailed description of the opening means according to the invention, reference is made primarily to FIG. 2 which shows the opening means on a larger scale and partially in cross-section, in the closed condition.

FIG. 2 shows a part of the container of FIG. 1, more precisely a part of the top face 1 of the container, a part of one side face 2 of the container, and an edge line 9 which is disposed between the two faces 1 and 2. Disposed in the top face 1 of the container, as already mentioned, is a pouring opening 6 whose forward end is adjacent the edge line 9 (usually at a distance of from 5 to 10 mm). The pouring opening 6 is of an oval or teardrop-like configuration and is so arranged that its longer axis of symmetry is normal to the edge line 9. This arrangement substantially facilitates pouring the contents of the container through the pouring opening, as, when the container is held at an angle to pour out its contents, the contents can flow out through the part of the pouring opening 6 which is closest to the edge line 9, while at the same time air can flow into the container through the opposite part of the pouring opening, whereby the quantity of liquid poured out of the container is being continuously replaced with the corresponding amount of air, thus ensuring that a vacuum is not formed in the container and thus avoiding the pouring problems which result therefrom, in the form of so-called gurgling, as the liquid contents is poured out.

When the opening means is in the FIG. 2 unopened position, the pouring opening 6 is covered with a layer 7 which can be broken open. This layer 7 is in the form of a cover strip which is made from flexible plastics material, and which is usually also referred to as a pull-tab. The pull-tab is so disposed on the top face 1 of the container, that it covers the pouring opening 6, and extends over the edge line 9 and down along the side face 2 of the container, where it terminates at a small distance below the edge line 9 in a free end portion 11. The end portion 11 is bent outwardly somewhat from the side face 2 of the container and serves as a pulling tab when the container is to be opened. The cover strip 7 is joined to the outside of the container, partly at the top face 1 of the container, in region 12 which is in front of the pouring opening (i.e. to the right in the drawing), and partly in one or more regions 13 at the side face 2 of the container; the one or more regions 13 are disposed directly at a fold line 14 which delimits the above-mentioned pulling tab 11 from the remainder of the cover strip 7. The above-mentioned sealing regions 12 and 13 are formed by heating and pressing together the thermoplastic cover strip and the thermoplastic outer layer of the material forming the container. The sealing region 13 is of very restricted area and only serves to hold the part of the cover strip 7, which lies against the side face 2, in the position shown in FIG. 2, before the container is to be opened. The sealing region 12 at the opposite end of the cover strip is of considerably larger area and is provided not only to hold the cover strip 7 against the top face 1 of the container when the container is still unopened, but also serves to connect the cover strip 7 to the container after the container has been opened, that is to say, when the two sealing regions 13 have been broken by pulling on the pulling tab 7 and the cover strip 7 has been bent over to the open position, as shown in FIG. 1. By virtue of this arrangement the cover strip 7 remains on the container even after the container has been opened, and can be used for re-closing the pouring opening 6.

As will be seen from the foregoing description, neither the sealing region 12 nor the sealing region 13 have a fluid-tight sealing function. Instead, the air-tight and fluid-tight closure of the pouring opening 6 is provided by a further layer 15 of material, which is disposed in the container and which is largely identical to the cover strip 7 in respect of shape and length. The layer 15 is made of thermoplastic material and is sealed to the inward face of the container inter alia in a region 16 which is disposed around the pouring opening 6. In order to provide a satisfactory pouring opening when the cover strip 7 is removed from the top face of the container, the cover strip 7 and the layer 15 are joined together in a sealing region 17 which is in the pouring opening 6. By virtue of this arrangement, when the cover strip 7 is removed, the portion of the layer 15 which is in the pouring opening 6 tears primarily along the periphery of the pouring opening 6, and the cover strip 7 is torn away therewith in such a way that the pouring opening 6 is opened and the contents of the container can be discharged therefrom.

In order to ensure that, when the container is being emptied, the contents of the container do not flow along the side face 2 after they have passed along the flow path between the pouring opening 6 and the edge line 9 on the upper face 1 of the container, the opening means according to the invention has an extensible pouring edge member 8. The pouring edge member 8 is formed by a slot 18 which extends through the material of the container and which is formed in the side face 2. The slot 18 extends substantially parallel to and at a spacing of from 1 to 5 mm relative to the edge line 9, at an inclined angle in an upward direction. Both the slot 18 and the end portions 19 thereof extend entirely through the material forming the container. To prevent the contents of the container from leaking through the slot, the above-mentioned layer 15 is sealed to the inside surface of the material of the container, not only at the region 16 which surrounds the pouring opening 6 but also at a further sealing region 20 which in part coincides with the region 16 and extends around the slot 18 and seals off from the interior of the container both the slot 18 and its end portions 19. With this arrangement, the layer 15 forms a pocket which lies behind the pouring edge member and in which the layer 15 and the pouring edge member 8 are not joined together. As this pocket is fluid-tight separated from the interior of the container by the region 20 around the slot 18, the contents of the container do not leak out through the slot 18 when the pouring edge member is in the inoperative position shown in FIG. 2, or when the pouring edge member 8 is in the open position shown in FIG. 1. As the originally flat material for forming the container enjoys a certain degree of inherent elasticity, when the cover strip 7 is removed the pouring edge member 8 automatically folds outwardly and forms a projecting edge. Depending on the type of material, when the pouring edge member 8 is liberated by removal of the cover strip 7, the pouring edge member 8 will move into an operative or active position in which it is more or less disposed in the same plane as the top face 1 of the container. If the container and thus also the pouring edge member are made of a material which is a pure plastics material, comprising a central layer of polystyrene foam covered on both sides with layers of homogenous thermoplastic material, then the elasticity of this material is sufficient to move the pouring edge member 8 fully into its operative position so that it is virtually completely in the same plane as the top face 1 of the container.

With some kinds of container material, which have a poor degree of elasticity, it may be necessary to provide for means which facilitate the outward pivotal movement of the pouring edge member, in conjunction with the operation of opening the opening means. This can be achieved for example by the cover strip 7 also being joined to the outside surface of the pouring edge member 8 by means of a releasable sealing connection, or alternatively by providing a layer of material of the type (for example resilient plastics material) which after having been bent attempts to return to a planar position, such layer of material being so arranged as to extend over the edge line 9 and being joined both to the pouring edge member 8 and to the top wall 1 of the container.

In a known kind of opening means, the cover strip 7 is sealingly joined to the top face of the container, in a region which extends around the pouring opening. In this way the outer cover strip 7 also performs a sealing function, and a layer of material within the container, to give a sealing action at this position, is not required. If a pouring edge member according to the invention is to be combined with such a form of closure for closing the pouring opening, it will be understood that it is desirable for the layer 15 to be only of sufficient size to cover the slot 18 and its two end portions 19 and to be sealed to the inside surface of the container in a region around the pouring edge member 8. The part of the layer 15 which seals the pouring opening 6 from the interior of the container can thus be omitted.

Another alternative embodiment of the opening means is also conceivable, and is particularly advantageous in the above-described kind of opening means in which the cover strip 7 is fluid-tightly sealed to the top face of the container. This further embodiment of the packaging means according to the invention also presupposes that the container which is provided with the opening means comprises a laminate material which has a fluid-tight layer towards the interior of the container, the fluid-tight layer being sufficiently strong and tough to be able to withstand the loadings applied thereto during the operations of manufacturing, filling and handling the container, without straining the other layers forming the material forming the container. In this embodiment, the inner plastics layer of the container is used as a sealing layer in front of the pouring edge member and the slots which form the pouring edge member, whereby it is possible to omit the above-described fluid-tight layer which is in the form of a separate strip of material. With this alternative embodiment, the other layers forming the material of the container must be removed from the inner plastics layer in the region of the pouring edge member 8, so that the pouring edge member 8 can be bent outwardly without hinderance, when the cover strip is removed from the container. This adhesion-free region which is required under the pouring edge member 8, and similarly for example the pouring opening and the slots forming the pouring edge member, must be formed when manufacturing the laminate material for forming the container; this may easily be effected by using one of a number of methods of preventing the component materials from being laminated together in certain regions thereof, for example by applying an adhesion-preventing agent in the above-mentioned regions, by providing a recess corresponding to that region in one of the rolls with which the layers for forming the container material are pressed together, whereby the layers are not pressed together, or by cooling the plastics layer to such a low temperature that there is no adhesive action.

In order further to facilitate producing the above-mentioned adhesion-free region, this may be in the form of a continuous region which extends continuously along the web of material, thus avoiding the necessity for ensuring that the positions of the adhesion-free regions are adapted to the positions of the pouring edge members which have already been stamped out. It has been found that the presence of a single continuous adhesion-free region is of no disadvantage as regards the finished container, as the resulting tubular space between the coating layer and the main layer of the container material is sealed off from the interior of the container, in the repeated operation of transverse sealing of the tubular web of container-forming material. The continuous adhesion-free region is advantageously formed by an operation in which the plastics material, during the coating step, is continuously subjected to a blast of compressed air and cooled.

The opening means according to the invention is produced by forming the pouring opening 6 and slots 18 and 19 in the container material while it is still in the form of a web, at equal intervals whose length corresponds to the length of material for forming each container. The web of material is already provided with a preliminary trace for the bend line, to facilitate the last operation of making the container into its parallelepiped shape, and the operation of punching out the pouring opening 6 and the slots 18 and 19 can therefore be performed with a high degree of precision, for example in relation to the bending line which marks the future edge line 9 to be formed. After the punching operation, the web of container material receives the layer 15 at the appropriate points thereon; after the application operation, the layer 15 is heated to a suitable temperature and sealed to the web of container material in the regions 16 and 20 disposed around the slots 18 and 19 and the pouring opening 6. In the subsequent operating stations, cover strips 7 are fitted to the container material, the cover strips being applied from the opposite side, heated, and sealed to the container material in the regions 12 and 13. The material which is provided in this way with the opening means of the invention is thereupon passed into a packaging machine of the known type, in which it is converted into individual filled containers.

In order to further to promote the automatic outward pivotal movement of the pouring edge member when the cover strip 7 is removed, it is advantageous for the fold line which defines the edge line 9 to be interrupted in the region in which it joins the pouring edge member, whereby the pouring edge member is subjected to a higher force for returning it to a position in which it is in the same plane as the top wall of the container.

It is also advantageous according to the invention for connecting positions 22, which are for example welded or adhesive positions, to be provided between the tear-off layer 7 and the pouring edge member 8, in the lower region of the pouring edge member, that is to say, in the area defined by the slots 18 and 19 and the fold line 9. These connecting positions will provide an additional force for assisting the pouring edge member to move into its upward extended position when the layer 7 or the cover strip 7 is torn off, in addition to the resilient force already inherent in the material forming the pouring edge member. At any event however it is advantageous for both the top surface 1 of the container and also the pouring edge member 8 to be of a material which has a sufficient degree of inherent resiliency for the pouring edge member to pivot upwardly into the plane of the top wall 1.

The opening means is rendered particularly easy to operate, and can be used for re-closing the container, by a further preferred feature according to the invention, namely that the layer 7 which is in the form of a tear-off cover strip is coated with thermoplastic material and is non-releasably secured to the top wall 1 of the container, at the end of the cover strip 7 which is remote from the pouring edge member 8. In this case, the user of the container pulls the cover strip 7 up, although the end of the cover strip 7 remote from the pouring edge member 8 is secured to the body of the container at a sealed seam (not shown in the drawings) which extends transversely across the top wall 1 of the container. This seam may be necessary for example in manufacturing the container, that is to say, in the operation of closing the tube for forming the container, as is the case with the seam 4 in the FIG. 1 embodiment. It will be understood that a sealed seam as mentioned above, which extends across the top wall 1 parallel to the edge 9, is made very firm so as to ensure that the cover strip 7 cannot be torn off beyond this limit. Consequently, after the container has been opened in use thereof, the cover strip 7 reliably remains approximately in the position shown in FIG. 1, and is therefore available for re-closing the opening 6. If in a preferred embodiment the cover strip 7 comprises a thin metal foil, the gripping end portion thereof may be pressed under the somewhat projecting pouring edge member 8 (see FIG. 1), so that the pouring opening 6 can be re-closed in a dust-proof manner.

The opening means according to the invention provides for the simple and uncomplicated formation of a satisfactory pouring edge member which projects from the edge line of the container after the container has been opened. In the inoperative or inactive position, the pouring edge member is well protected and is highly unlikely to suffer damage in handling, so that it operates well when the container is opened.

I claim:

1. In a container made from folded flexible material, and intended to package pourable products, the container having a top wall (1) and at least one side wall (2) connected to the top wall along a fold line (9), a pouring opening (6) in the top wall adjacent the one side wall, and a cover strip (7) attached to the top wall on the opposite side of the opening from the fold line, the cover strip extending across the opening toward the fold line when in position to cover the opening; the improvement comprising a slot (18) formed in said one side wall spaced from said fold line and terminating at its opposite edges (19) at said fold line defining a pouring edge member (8) movable from a first position extending along said one side wall to a pouring position extending approximately in the plane of said top wall and outwardly from said fold line, said cover strip projecting across said fold line and over said pouring edge member holding the pouring edge member in its first position until said cover strip is moved to uncover the pouring opening, and a fluid-tight layer (15) is sealed to the interior of said top wall and said one side wall covering said slot.

2. A container as defined in claim 1, wherein said layer extends across said pouring opening, the portion of said layer covering said pouring opening being fastened to said cover strip and being severable from the remainder of said layer when said strip is moved to uncover said opening.

3. A container as defined in claims 1, or 2, wherein the majority of said slot (18) is parallel to said fold line and spaced therefrom between 1 to 5 mm.

4. A container as defined in claims 1, or 2, wherein at least a portion of said pouring member is releasably attached to said cover strip to cause the pouring member to move to its pouring position as the cover strip is opened.

5. A container as defined in claims 1, or 2, where in the material of the container and the crease of the fold line are such that said pouring member is urged into its pouring position once it is released by opening said cover strip.

6. A container as defined in claim 1, or 2, wherein said cover strip is a part separate from the container material, and said cover strip is releasably attached (13) to said side wall.

* * * * *

UNITED STATES PATENT AND TRADEMARK OFFICE

CERTIFICATE OF CORRECTION

PATENT NO. : 4,312,450

DATED : January 26, 1982

INVENTOR(S) : Wilhelm Reil

It is certified that error appears in the above—identified patent and that said Letters Patent is hereby corrected as shown below:

Column 5, line 32, "is torn" should be --pulls--.

Column 5, line 32, "therewith" should be --this portion of layer 15--.

Signed and Sealed this

*Twentieth* Day of *April 1982*

|SEAL|

*Attest:*

GERALD J. MOSSINGHOFF

*Attesting Officer*

*Commissioner of Patents and Trademarks*